US009279582B2

(12) United States Patent
Petrosky et al.

(10) Patent No.: US 9,279,582 B2
(45) Date of Patent: Mar. 8, 2016

(54) METHOD AND APPARATUS FOR DELIVERING A TOOL TO THE INTERIOR OF A HEAT EXCHANGE TUBE

(71) Applicant: Westinghouse Electric Company LLC, Cranberry Township, PA (US)

(72) Inventors: Lyman J. Petrosky, Latrobe, PA (US); Kurt K. Lichtenfels, Pittsburgh, PA (US); Phillip J. Hawkins, Irwin, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 309 days.

(21) Appl. No.: 13/891,219

(22) Filed: May 10, 2013

(65) Prior Publication Data

US 2014/0332178 A1 Nov. 13, 2014

(51) Int. Cl.
*F28G 13/00* (2006.01)
*F22B 37/00* (2006.01)

(52) U.S. Cl.
CPC ..... *F22B 37/005* (2013.01)

(58) Field of Classification Search
CPC ..... F22B 37/003; F22B 37/48; F22B 37/52; F22B 37/54; F23J 3/023; F28G 9/00
USPC ..... 122/379, 396, 397; 324/220
See application file for complete search history.

(56) References Cited

U.S. PATENT DOCUMENTS 3,906,358 A * 9/1975 Stone ..... F22B 37/003 324/220
4,199,975 A 4/1980 Schrock et al.
5,025,854 A * 6/1991 Richter ..... F22B 37/003 165/112
5,105,876 A * 4/1992 Burack ..... F22B 37/003 165/11.2
5,355,063 A * 10/1994 Boone ..... F22B 37/005 165/11.2
5,583,898 A * 12/1996 Hydeman ..... B23D 31/002 376/211
5,611,948 A * 3/1997 Hawkins ..... B65H 63/00 219/121.63
7,314,343 B2 1/2008 Hawkins et al.
8,176,883 B2 * 5/2012 Brown ..... F22B 37/52 122/379
8,390,278 B2 3/2013 Petrosky
8,646,416 B2 * 2/2014 Hawkins ..... F22B 37/003 122/379
2003/0121340 A1 7/2003 Hawkins et al.
2006/0207525 A1 * 9/2006 Hernandez ..... F22B 37/486 122/396
2011/0079186 A1 * 4/2011 Hawkins ..... F22B 37/003 122/390
2014/0332178 A1 * 11/2014 Petrosky ..... F22B 37/005 165/11.2

FOREIGN PATENT DOCUMENTS

EP 0727651 A1 8/1996
WO 2010132750 11/2010

OTHER PUBLICATIONS

International Search Report and Written Opinion of the International Searching Authority for PCT/US2014/015516 dated May 19, 2014 (Forms PCT/ISA/220, PCT/ISA/210, PCT/ISA/237).

* cited by examiner

*Primary Examiner* — Gregory A Wilson
(74) *Attorney, Agent, or Firm* — Richard J. Coldren; Westinghouse Electric Company LLC

(57) ABSTRACT

A delivery system for remotely driving an eddy current probe through the tubing of a heat exchanger. The system uses a flexible shaft and air pressure to move an inspection probe through the heat exchanger tubes. The flexible shaft initially drives the probe through a sealed conduit to deliver the probe to the tube end at which point a seal on the shaft near the probe head contacts the tube inner surface allowing a buildup of air pressure behind the seal, thus driving the probe through the tube.

9 Claims, 7 Drawing Sheets

METHOD AND APPARATUS FOR DELIVERING A TOOL TO THE INTERIOR OF A HEAT EXCHANGE TUBE

BACKGROUND

1. Field

The present invention relates generally to a tool delivery system and more particularly to a method and apparatus for remotely delivering a tool to the interior of a heat exchanger tube.

2. Related Art

In pressurized water reactor nuclear power plants, steam generator heat exchangers convert the thermal energy of water from the reactor core to steam to drive turbine electric generators. In order to transfer the heat while maintaining separation between the high pressure water that flows through the reactor core and the lower pressure water that is converted to steam, steam generators are constructed of thousands of small diameter tubes which provide a large surface area for heat transfer. The number of tubes in a steam generator typically ranges from about 4,000 to 15,000. Some steam generators utilize straight length tubes each about 60 feet (18.3 meters) long. Most of the steam generators are constructed of U-shaped tubing or long vertical sections with two 90 degree bends joined by a shorter horizontal length of tubing. All the tubes terminate in a thick plate, commonly known as a tube sheet, with an array of holes drilled in it that capture the ends of the tubes and interface with a channel head that forms the inlet and outlet plenums for the primary coolant from the reactor core. During plant operation, the high pressure water that flows through the reactor core transports some amount of radioactive particles through the steam generators and some particles become deposited on the interior surface of the tubes. After plant operation, the steam generators become a source of radiation.

Periodic inspection with eddy current probes is widely utilized to ensure the structural integrity of the steam generator tubing. Due to the elevated radiation fields within the steam generators, robotics and remote controlled motorized devices are used to position and translate eddy current probes through the tubes. The cost of equipment, labor, plant down time and the benefit of minimizing personnel radiation exposure make it highly desirable to optimize the performance and capability of the eddy current inspection process.

The inspection is performed by pushing spooled probes located outside the steam generator through a flexible conduit into a steam generator plenum in the channel head to the robotic manipulator which then routes the probe in a tube of the steam generator. Current systems typically use only a stiff shaft to push the probe through the conduit and tube. These systems are prone to jamming, making the inspection difficult. A few systems use an open air jet directed at the tube end to move the probe through the tube, but the resultant probe driving force is small and the jet of air tends to disperse radioactive contamination making the method undesirable.

Accordingly, it is an object of this invention to provide an eddy current delivery system that will ease passage of an eddy current probe through a delivery conduit and through a heat exchange tube with a minimum of resistance.

It is a further object of this invention to provide such a delivery system that can be deployed efficiently and will minimize the spread of radioactive contamination.

SUMMARY

These and other objects are achieved by a tool delivery system for remotely transporting a tool through a heat transfer tube of a heat exchanger having a plenum in fluid communication with an interior of the heat transfer tube through a first tube end and an access portal for accessing the interior of the plenum. The tool delivery system has a sealable delivery conduit sized to extend from a first location outside the plenum, through the access portal to the first tube end and a flexible shaft for pushing the tool through the delivery conduit into the heat transfer tube. A first seal is supported within the vicinity of a forward portion of the flexible shaft and forms a substantially fluid tight, slidable seal between the interior of the heat transfer tube and the flexible shaft when the flexible shaft is inserted a given distance into the heat transfer tube. A second seal is positioned on a portion of the delivery conduit that is to be positioned outside the plenum and the second seal is supported in a manner that forms a substantially fluid tight seal between the flexible shaft and an interior of the delivery conduit while enabling the flexible shaft to slide therethrough. A fluid inlet is formed on the delivery conduit in fluid communication with the interior of the delivery conduit, between the second seal and the first tube end, for the introduction of a fluid to drive the tool along the interior of the heat transfer tube. Preferably, a third seal is supported at an end of the delivery conduit that is configured to interface with the first tube end. The third seal is structured to form a substantially fluid tight seal between the first tube end and the delivery conduit while enabling the tool and the flexible shaft to pass therethrough. The flexible shaft is sufficiently rigid to push the tool forward until the first seal seats within the heat transfer tube to form the substantially tight seal between the flexible shaft and the interior of the heat transfer tube.

In one embodiment, a fourth seal is provided upstream of the second seal; the fourth seal being structured to provide a substantially fluid-tight seal between the flexible shaft and the delivery conduit, while enabling the flexible shaft to slide therethrough with the space within the interior of the delivery conduit between the second seal and the fourth seal forming a chamber having a port through a wall of the chamber via which negative ventilation may be applied. Desirably, both the first and second seals are configured so that the tool and the flexible shaft can exit the delivery conduit which is preferably supported in sealed fluid communication with the first tube end with the robotic arm.

In one of the embodiments the first seal includes a plurality of circumferential outer segments that overlap a plurality of circumferential inner segments with the outer and inner segments being biased in an outwardly direction. Preferably, the first seal includes a fluid path having an inlet on an upstream side of the first seal in fluid communication with an inward surface of the inner segments. In another embodiment the first seal includes circumferentially alternating seal pads and resilient elastomeric foam seal segments wherein the elastomeric foam seal segments conform to both the seal pads and an interior wall of the heat transfer tube to create a substantially fluid tight, slidable seal between the interior wall and the tool.

The invention also contemplates a method of delivering a tool through an access portal and plenum and into a heat transfer tube of a heat exchanger. The method includes the step of inserting a delivery conduit into the plenum of the heat exchanger, with one end of the delivery conduit in fluid communication with one end of the heat transfer tube and a second end of the delivery conduit outside of the plenum. The method inserts the tool into the second end of the delivery conduit and inserts a flexible shaft into the second end of the delivery conduit in back of the tool so that the tool is between the flexible shaft and the heat transfer tube. The method then pushes the flexible shaft and the tool through the delivery conduit and into the heat transfer tube slidably sealing the flexible shaft around the circumference of an inner wall of the heat transfer tube with a first seal to form a substantially fluid-tight seal while enabling the flexible shaft to move within the heat transfer tube. The method drives the flexible shaft from outside the second end of the conduit through a second seal slidably sealing the flexible shaft at the second end of the conduit. The method then forces a fluid into the delivery conduit and thereby into one end of the heat transfer tube to move the tool through a portion of the interior of the heat transfer tube. In one embodiment, the method includes the step of creating a substantially fluid-tight seal with a third seal supported between the delivery conduit and the heat transfer tube with the third seal configured to enable the flexible shaft and the tool to slide therethrough. Preferably, the method includes creating a fluid inlet through the delivery conduit between the second seal and the third seal for the introduction of a fluid to drive the tool through a portion of the interior of the heat exchange tube.

In still another embodiment, the method includes the steps of creating a chamber attached to the second end of the conduit by slidably sealing a portion of the flexible shaft between the interior wall of the chamber and the flexible shaft with a fourth seal supported by a vessel extending between the second end of the delivery conduit and the fourth seal to create a chamber in the interior of the vessel between the second seal and the fourth seal that the flexible shaft can slide through; with a fluid coupling provided in the chamber for an application of negative ventilation. Preferably, all the seals are configured so that the flexible shaft and tool can exit the delivery conduit from the interior of a heat transfer tube.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
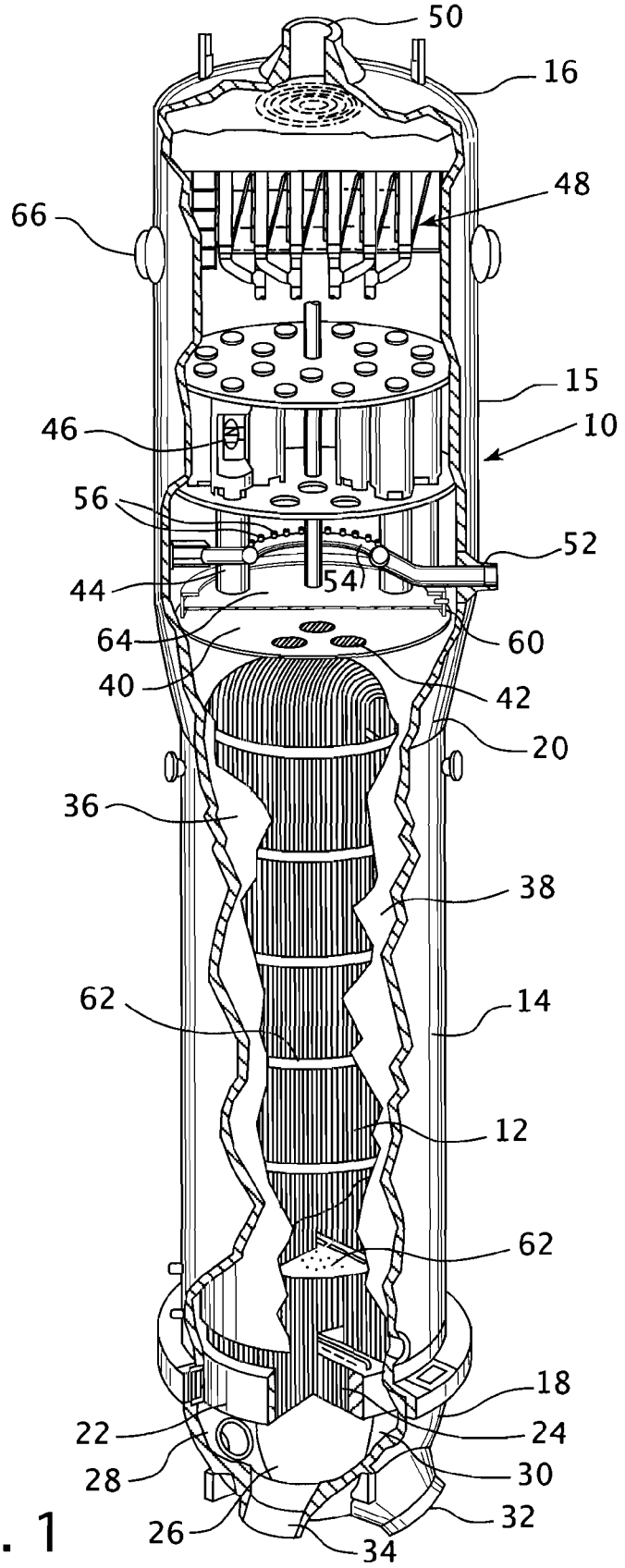
FIG. 1 is a perspective view, partially cut away, of a vertical steam generator for which the delivery system of this invention can be applied.

Referring to the drawings, FIG. 1 shows a steam or vapor generator 10 that utilizes a plurality of U-shaped tubes which form a tube bundle 12 to provide the heating surface required to transfer heat from a primary fluid traveling within the tubes to vaporize or boil a secondary fluid surrounding the outside of the tubes. The steam generator 10 comprises a vessel having a vertically oriented lower tubular shell portion 14, a vertically oriented upper shell portion 15, a top enclosure or dished head 16 enclosing the upper end and a generally hemispherical-shaped channel head 18 enclosing the lower end. The lower shell portion 14 is smaller in diameter than the upper shell portion 15 and the lower shell and upper shell are connected by a frustoconical shell section 20. A tube sheet 22 is attached at the bottom end of the lower shell portion 14, to the channel head 18 and has a plurality of holes 24 disposed therein to receive ends of the U-shaped tubes. A dividing plate 26 is centrally disposed within the channel head 18 to divide the channel head into two compartments 28 and 30, which serve as headers for the tube bundle. Compartment 30 is the primary fluid inlet compartment and has a primary fluid inlet nozzle 32 in fluid communication therewith. Compartment 28 is the primary fluid outlet compartment and has the primary fluid outlet nozzle 34 in fluid communication therewith. Thus, primary fluid, i.e., the reactor coolant, which enters fluid compartment 30 is caused to flow through the tube bundle 12 and out through outlet nozzle 34. The tube bundle 12 is encircled by a wrapper 36 which forms an annular passage 38 between the wrapper 36 and the shell and cone portions 14 and 20, respectively. The top of the wrapper 36 is covered by a lower deck plate 40 which includes a plurality of openings 42 in fluid communication with a plurality of riser tubes 44. Small vanes 46 are disposed within the riser tubes to cause steam flowing therethrough to spin and centrifugally remove some of the moisture entrained within the steam as it flows through the primary centrifugal separator. The water separated from the steam in the primary separator is returned to the top surface of the lower deck plate. After flowing through the primary centrifugal separator, the steam passes through a secondary separator 48 before reaching a steam outlet 50 centrally disposed in the dished head 16.

The feedwater inlet structure of this generator includes a feedwater inlet nozzle 52 having a generally horizontal portion called a feedring 54 and discharge nozzles 56 elevated above the feedring. The feedwater supplied through the feedwater inlet nozzle 52 passes through the feedring 54 and exits through discharge nozzles 56 and mixes with water which was separated from the steam and is being recirculated. The mixture then flows down above the lower deck plate 40 into the annular passage 38. The water then enters the tube bundle at the lower portion of the wrapper 36 and flows along and up the tube bundle where it is heated to generate steam.

The steam generator described above is what is known as a "U-bend" design, because every tube has a single "U" bend midway along its length. A number of other design variations are commonly encountered, such as "square bend" in which the "U" is replaced by two small radius bends (typically 90 degrees) and a straight section therebetween. There are also steam generators with entirely straight tubes, which feature a plenum at each end of the tube bundle. Regardless of the specific tube pattern and bend arrangement, the invention described herein is applicable to inspect and service the tubes.

Though the invention is described in an application for delivering eddy current probes, it should be appreciated, that the delivery system and method described herein can be employed to deliver other tools required to service a steam generator.

Figure 2:
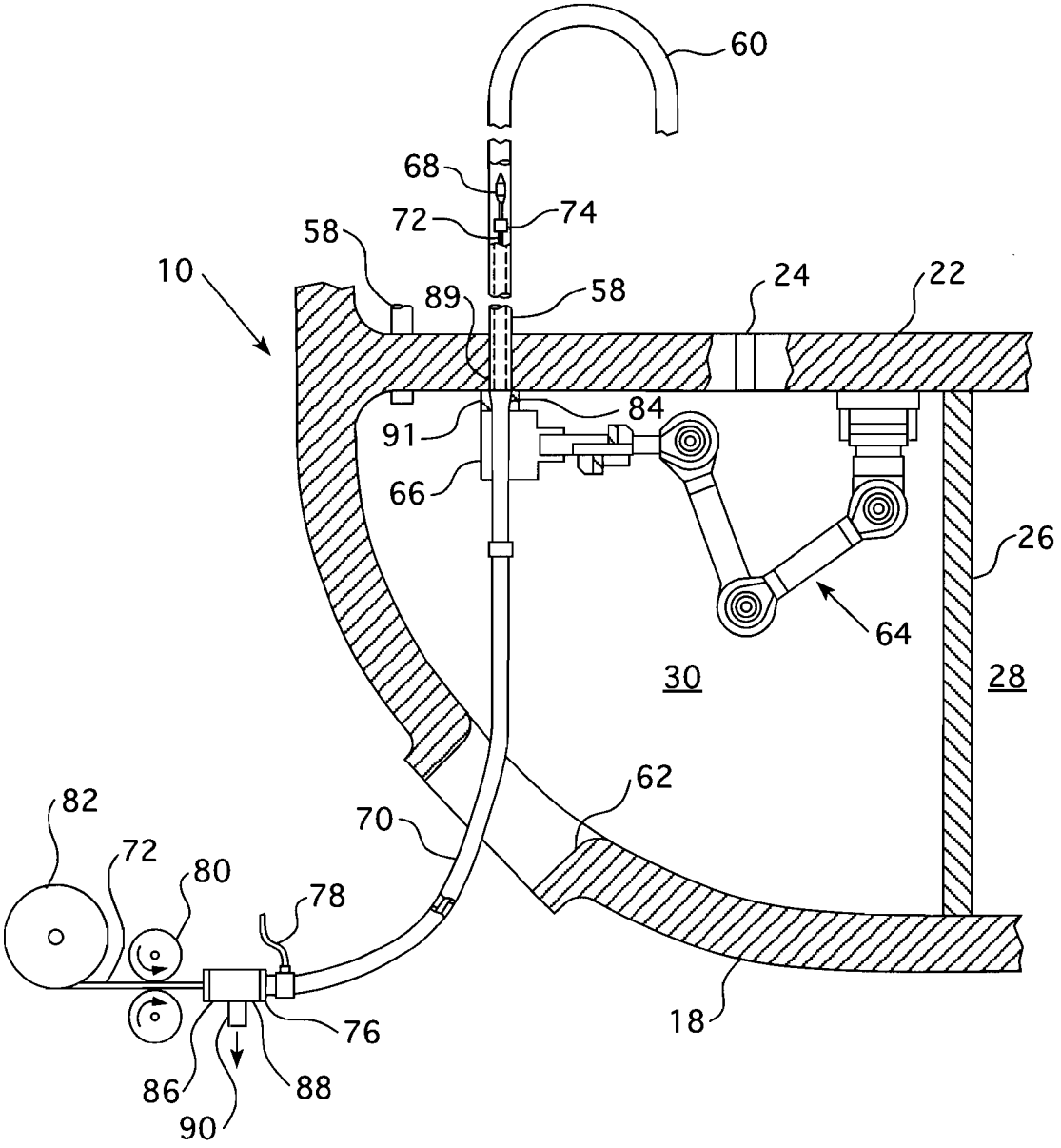
FIG. 2 is a cross section of one half of a channel head of the steam generator of FIG. 1 schematically illustrating the delivery system of one embodiment of this invention connected to one end of a U-shaped heat exchange tube and supported with a robotic arm.

FIG. 2 illustrates a plenum 30 in a channel head 18 of a steam generator 10 bounded on its upper side by the tube sheet 22 and on the right by the channel head divider plate 26, separating the inlet plenum 30 from the outlet plenum 28 shown in FIG. 1. The apparatus employed with one embodiment of this invention is also shown in FIG. 2 and may be deployed in either the inlet or the outlet plenum interchangeably. The apparatus includes a delivery conduit 70 that extends from the exterior of the channel head 18, through a access portal 62 to the interior of plenum 30, with a forward end 91 of the delivery conduit 70 supported by an end effector 66 of robotic arm 64, against an opening 24 in the tube sheet 22. An example of such a robotic arm can be found in U.S. Pat. No. 5,355,063, issued Oct. 11, 1994 to the assignee of this application. The system of this invention uses a flexible shaft 72 in combination with a fluid pressure, such as air, to move a tool, for example, an eddy current probe 68, or other tool, through the delivery conduit 70 and a heat exchanger tube 58. The shaft 72 is designed such that it is sufficiently rigid to push the probe 68 to the tube end 89 without the aid of air pressure, while flexible enough to bend while traversing bends 60 in the tubing 58 to be inspected. The probe 68 with a shaft-tube seal 74 are initially pushed forward through the delivery conduit 70 using only the flexible shaft 72 for propulsion. In this embodiment, no air pressure is utilized in this phase of the insertion, because the probe lacks the means to form an air seal with the interior surface of the delivery conduit 70. Once the probe passes the heat exchanger tube end 89, the shaft-tube seal 74 (seal No. 1) on the shaft 72, mates with the interior surface of the tube 58 to create an air seal behind the probe 68. The delivery conduit 70 used to deliver the probe 68 to the heat exchanger tube end 89 has air seals that at both ends, i.e., air seals 76, 84 (seals Nos. 2 and 3, respectively) that are sufficiently air tight to permit the buildup of air pressure behind the shaft-tube seal 74, while enabling the shaft 72 to slide through the delivery conduit 70 and the heat exchanger tube 58. Upon achieving the shaft-tube seal in the heat exchanger tube 58, air is injected into the delivery conduit 70, through the air inlet 78 and travels the length of the delivery conduit 70 through the inlet end 89 of the heat exchanger tube 58 to force the probe 68 to travel along the interior of the heat exchanger tube 58. The inlet to the delivery conduit 70 has a fourth seal 86 upstream of the second seal 76 through which the flexible shaft 72 slides. The fourth seal 86 is structured to provide a substantially fluid tight seal between the flexible shaft 72 and the delivery conduit 70 with the interior of the delivery conduit, between the fourth seal 86 and the second seal 76, forming a chamber 88 having a connector for negative ventilation 90. A negative ventilation suction may be applied between the two seals 86 and 76 at the negative ventilation inlet 90 to collect air leakage from the forward side seal 76. The air is injected into the delivery conduit 70 upstream of the seal 76 at the air inlet 78. The embodiment illustrated in FIG. 2 also shows a take-up reel 82 for the flexible shaft 72 and push rollers 80 for driving the flexible shaft 72 through the delivery conduit 70 and withdrawing the flexible shaft 72 for inspection of the heat exchanger tube 58. A seal 84 (seal No. 3) is provided at the forward end of the delivery conduit 70 and is held firmly against the underside of the tube sheet 22, by the robotic arm 64 to maintain the air pressure responsible for driving the probe 68 through the heat exchanger tube 58. It should be appreciated that the seals were given numbers in the above description solely for the purpose of aiding the reader in following the description of this embodiment and the seal numbers, i.e., seals Nos. 1, 2, 3 and 4, have no other relevance. Additionally, it should be apparent that while air is described as the driving fluid for the probe, other fluids can be used for this purpose without detracting from this invention. Similarly, while the number 1 seal is described as being attached to the flexible shaft 72, alternately it could be attached to the probe 68.

Figure 3:
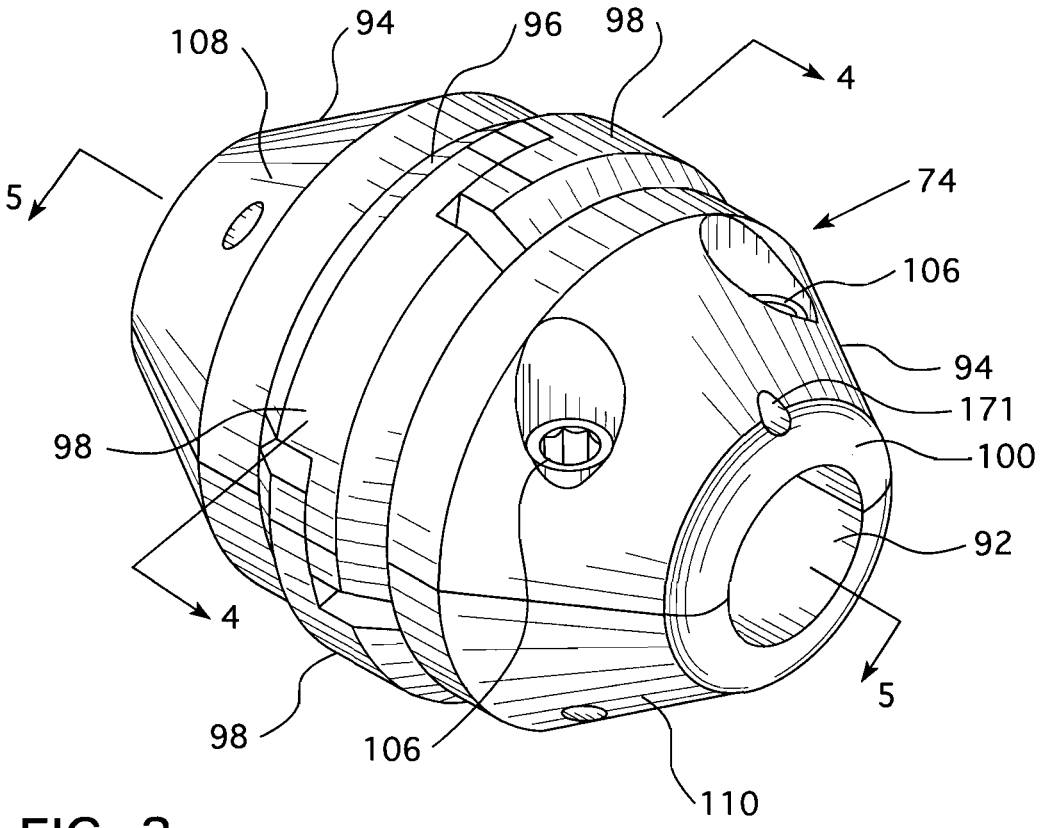
FIG. 3 is a perspective view of the slidable first seal of the embodiment shown in FIG. 2 that forms a sealing interface between the flexible shaft and an interior of the heat exchange tube.
Figure 4:
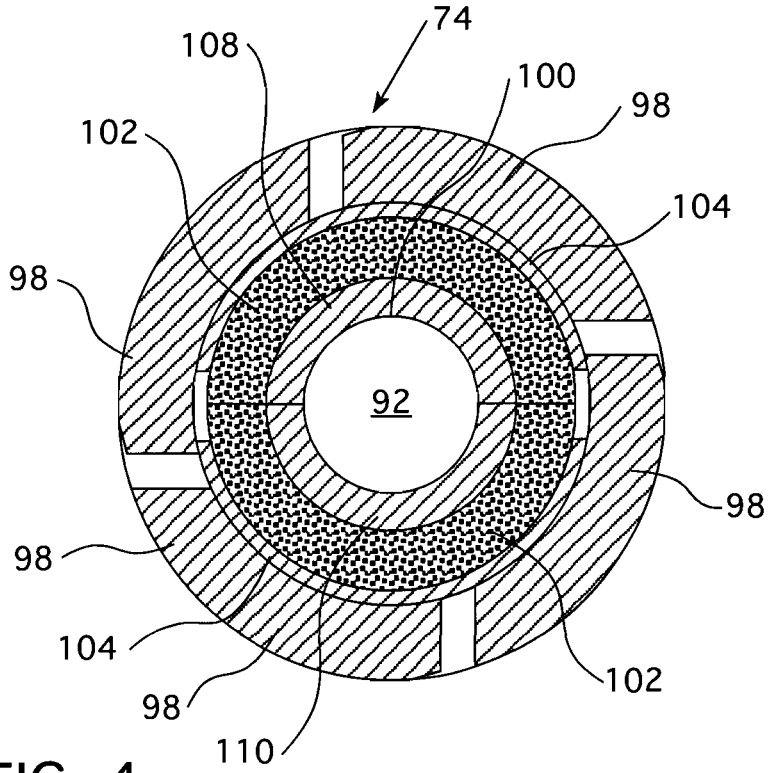
FIG. 4 is a cross sectional view of the seal illustrated in FIG. 3 taken along the lines 4-4 thereof.
Figure 5:
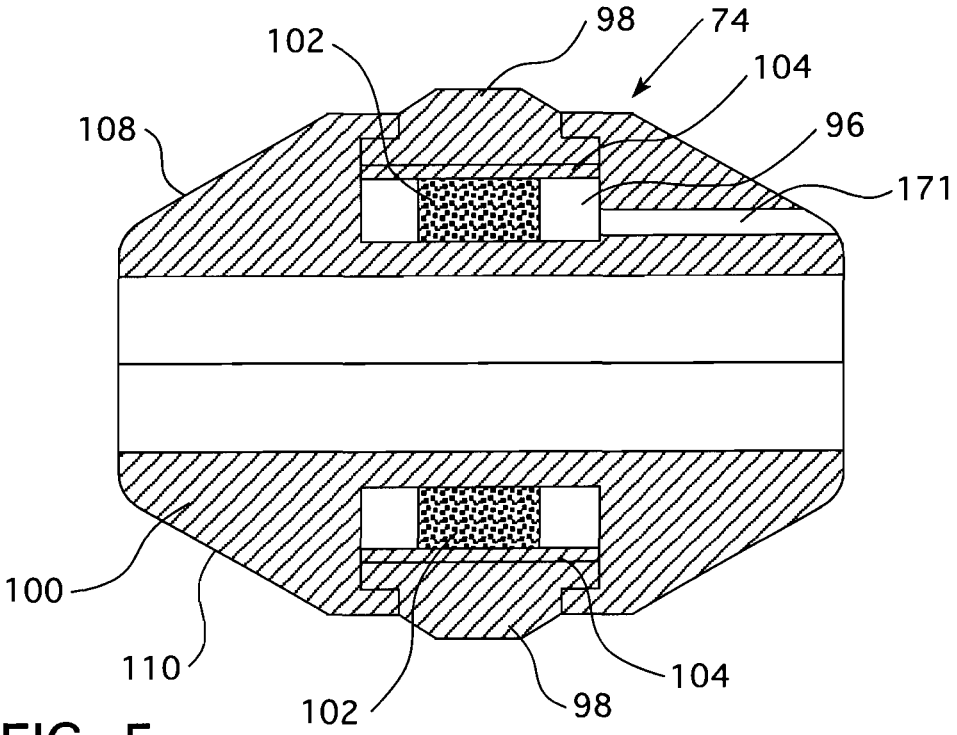
FIG. 5 is a cross sectional view of the seal of FIG. 3 taken along the lines 5-5 thereof.

FIG. 3 is an perspective view of the first seal 74, with FIG. 4 showing a cross section of the first seal along the lines 4-4 of FIG. 3 and FIG. 5 showing a cross section of the first seal along the lines 5-5 of FIG. 3. The first seal 74 has a central opening 92 through which the flexible shaft 72 is secured. The beveled ends 94 aid in positioning the seal centrally within the openings through which the flexible shaft is inserted and an axially central recess 96 that supports interleaved, spring loaded, seal pads 98. More particularly, referring to FIGS. 4 and 5, which show cross sections, respectively taken through the seal pads and axially through the housing, it can be better appreciated that the No. 1 seal housing 100 includes the recess 96 that houses a plurality of interleaved seal pads 98 which extend around the circumference of the housing and seat over a number of backup seals 104 supported between a spring 102 and the outer seal pads 98. As can be seen in FIG. 4, the backup seals 104 seal the gap between the interleaved outer seal pads 98. One end of the housing 100 contains hole 171 that is located on the pressurized side of the seal, which allows air pressure to enter under the backup seals counteracting the tendency for seal pads 98 to be pushed inward when sealing against the applied air pressure. The first seal housing 100 is constructed in two separate halves; a lower half 110 and an upper half 108. The two halves are separated to fit around the flexible shaft 72 and are tighten around the flexible shaft with the screws 106 to form a fluid tight seal.

Figure 6:
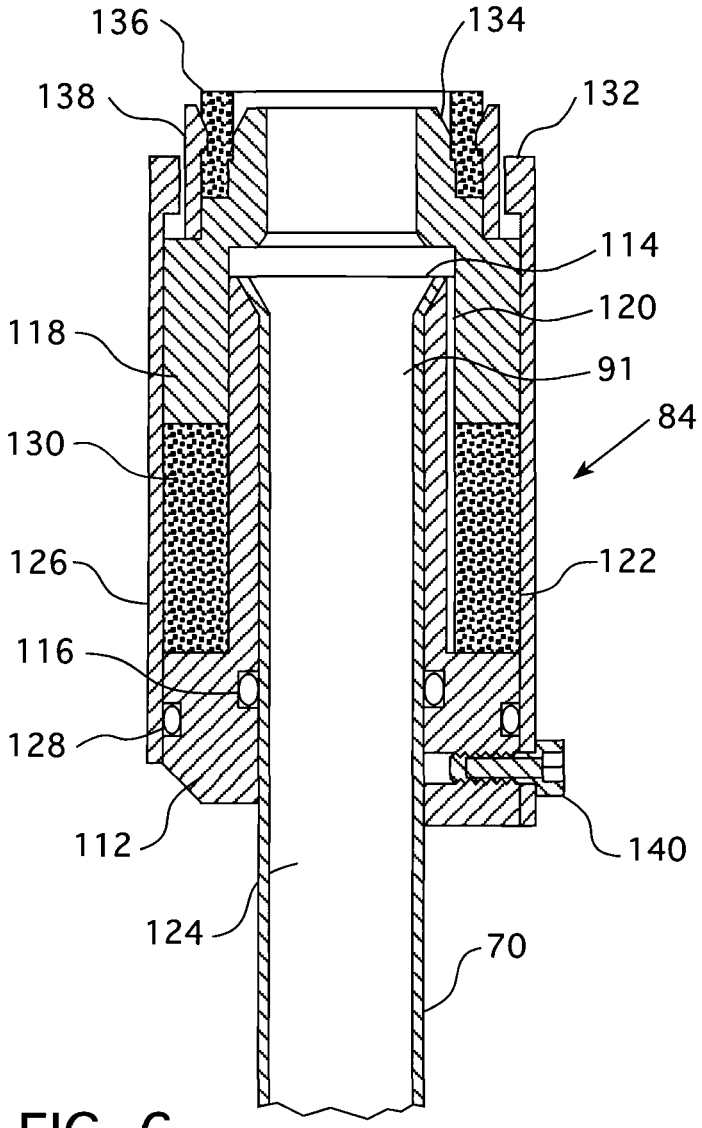
FIG. 6 is a cross sectional view of an end of the delivery conduit showing the tube sheet seal employed with the embodiment illustrated in FIG. 2.

FIG. 6 is a cross sectional view of the third seal 84 fitted over the forward end of the delivery conduit 70. The third seal interfaces with the opening in the tube 58 in the tube sheet 22. Adapter sleeve 112 encircles the delivery conduit 70 and is captured in place by a flared end 114 or equivalently a snap ring on the end of delivery conduit 70. An O-ring seal 116 seals off any fluid passage between the inner surface of the adapter sleeve 112 and outer surface of the delivery conduit 70. A tubular slide 118 sits over and around the open end 91 of the delivery conduit 70 and an upper portion of the adapter sleeve 112. An air passage 120 is provided between the tubular slide 118 and the adapter sleeve 112 to permit the exchange of air between an annular opening 122 around a portion of the adapter sleeve and the interior passage 124 within the delivery conduit 70 and the heat exchange tube 58, so that the upward movement of the tubular slide 118 is enhanced by the buildup of air pressure. The sidewalls of the annular opening 122 are enclosed by an outer sleeve 126 at its outer diameter and the adapter sleeve 112 at its inner diameter. The outer sleeve 126 is sealed to the adapter sleeve with an O-ring 128. A cylinder of resilient annular foam 130 resides in the annular opening 122 and extends between the tubular slide 118 which is captured at the upper most point of travel by an inwardly extending annular land 132 on the outer sleeve 126. The resilient annular foam 130 biases the slide 118 in an upward direction towards the opening in the tube sheet with which it is communicates. The tubular slide 118 has a reduced diameter nose 134 at its upper end with an opening sized to permit the passage of the probe 68 and flexible shaft 72. An annular tube sheet seal 136 is positioned around the nose 134 of the slide 118 and forms the seal with the tube sheet 22. The tube sheet seal is held in place by a retaining ring 138. The outer sleeve 126 is anchored to the adapter sleeve 112 by set screw 140. The robotic arm 64 end effector 66 grips the outside of the conduit 70 and pushes against sleeve 126 to press it up against the tube sheet 22 forcing the nose 134 of the slide 118 downward against the foam 130 which provides pressure on the seal 136 against the tube sheet 22 to form a fluid tight seal.

Figure 8:
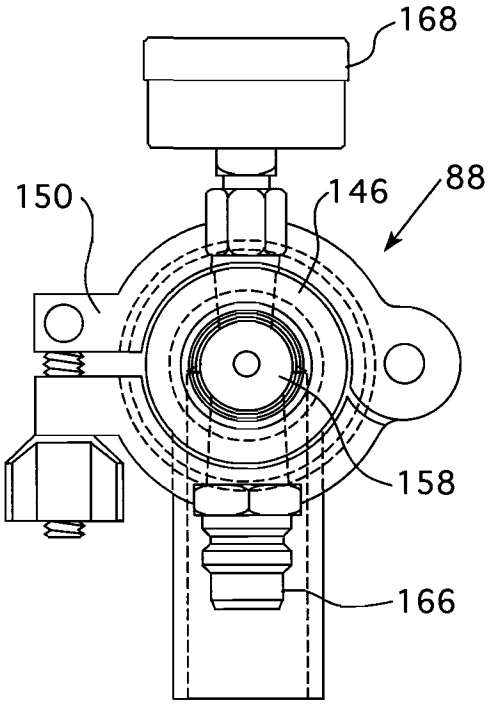
FIG. 8 is an end view of the conduit fluid inlet and negative ventilation chamber illustrated in FIG. 7 showing the fluid inlet end of the assembly
Figure 7:
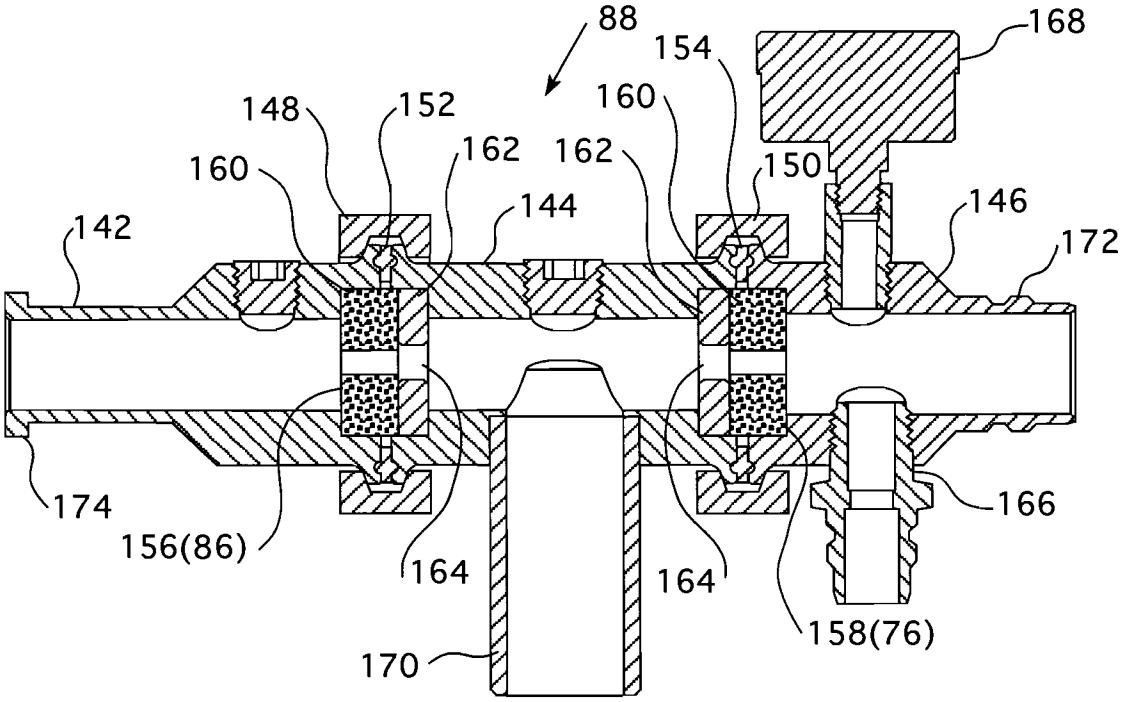
FIG. 7 is a cross sectional view of the combined conduit fluid inlet and negative ventilation chamber portion of the delivery conduit shown in FIG. 2.

FIGS. 7 and 8 show separate views of the air inlet and negative ventilation chamber assembly. The negative ventilation chamber is sealed by the second and fourth seals 76 and 86. The negative ventilation chamber 88 is formed from a housing constructed from three tubular sections 142, 144 and 146 which are connected at their interface by ring clamps 148 and 150 and sealed by corresponding gaskets 152 and 154. Seals 156 and 158 are seated in recesses, respectively at the intersections and on the interior walls of the tubular housing sections 142 and 144, and 144 and 146. The seals 156 and 158 are formed from a primary seal 160 and a more rigid backup disk 162 each of which has a central opening 164 through which the flexible shaft 72 passes. Seal 158 is the second seal 76 previously noted with regard FIG. 2 and seal 156 is the fourth seal 86.

A quick disconnect fitting 166 is provided for the introduction of compressed air into the delivery conduit 70 to drive the probe 68 through the heat exchanger tube 58 and the gauge 168 monitors the air pressure. Chamber negative ventilation is achieved by suctioning air from port 170. The nose 172 of the forward section 146 slips into the opening in the delivery conduit 70 and the rear opening 174 receives the flexible shaft 72. For all practical purposes, the negative ventilation assembly 88 can be considered part of the delivery conduit 70.

Figure 9:
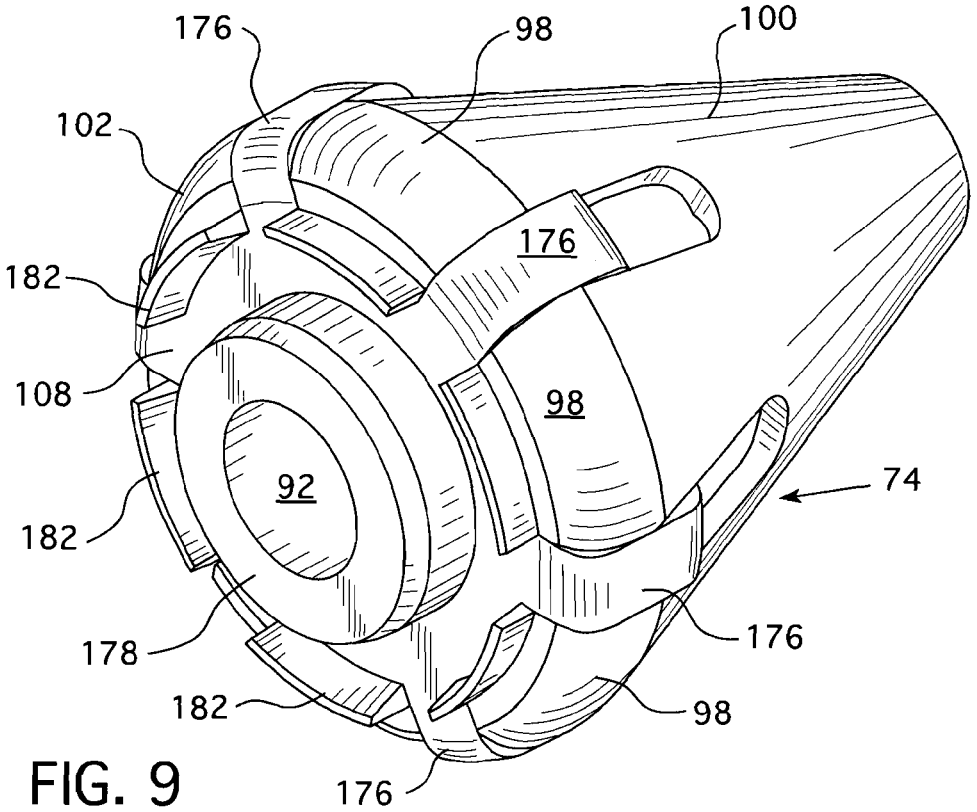
FIG. 9 is a perspective view of an alternate embodiment for the first seal shown in FIGS. 3, 4 and 5.
Figure 10:
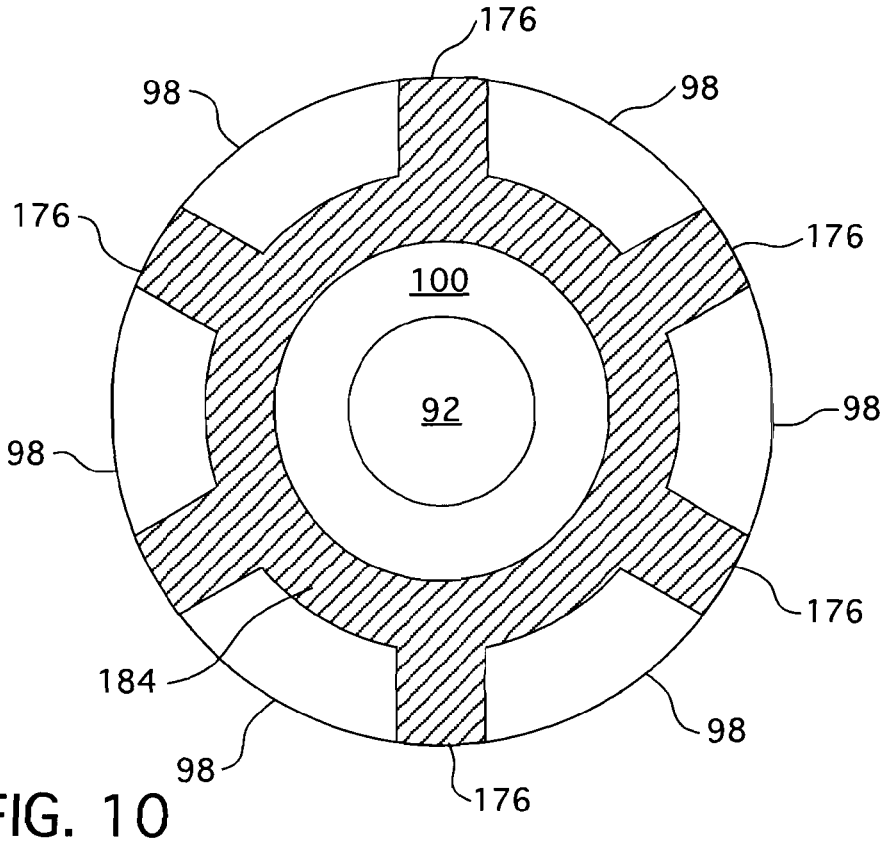
FIG. 10 is a cross sectional view of the alternate embodiment for the first seal illustrated in FIG. 9.

It should be appreciated that though exemplary designs have been shown for the seals, other seal designs may be employed without departing from the intent of the invention. For Example, FIGS. 9 and 10 illustrate an alternate design for the first seal 74 which employs circumferentially alternating seal pads 98 and resilient elastomeric foam seal segments 176. Like reference characters are employed to identify corresponding components among FIGS. 3, 4, 5, 9 and 10. FIG. 9 shows a perspective view of this embodiment of the first seal 74. The probe 68 may be affixed either in front of or behind the seal 74. In the embodiment illustrated in FIG. 9 the probe 68 (not shown in FIG. 9) is attached on the side 108 of the housing 100 that supports the seals 98, 176, to an outwardly projecting annular hub 178. The probe 68 in this embodiment has a circumferential undercut that fits over circumferential projections 182 to retain the seal pads 98 and prevent them from separating from the housing. FIG. 10 shows a cross section of FIG. 9 taken at the seals and shows the elastomeric foam 184 extending below the seal pads 98 and biases the seal pads in an outwardly direction. In this embodiment the central elastomeric foam component 184 is shown as an integral part of the elastomeric foam seals 176, though it should be appreciated that they can be constructed as separate components. Thus, with this embodiment the elastomeric foam seals 176 are integrated with the seal pads 98 such that the seal pads may deform, i.e., extend outward or compress inward, to accommodate variations in heat transfer tube internal diameter while the elastomeric foam seal 176 conforms to both the seal pads 98 and the tube to create a substantially fluid tight, slidable seal between the interior of the heat transfer tube and the tool; in this case the probe 68. It should be further appreciated that the first seal assembly 74 may be located anywhere in the vicinity of the tool.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A tool delivery system for remotely transporting a tool to and through a heat transfer tube of a heat exchanger having a plenum in fluid communication with an interior of the heat transfer tube through a first tube end and an access port for accessing the plenum, the tool delivery system comprising:

a sealable delivery conduit sized to extend from a first location outside the plenum, through the access port to the first tube end;

a flexible shaft for pushing the tool through the delivery conduit into the heat transfer tube;

a first seal supported within the vicinity of a forward portion of the flexible shaft and forming a substantially fluid tight, slidable seal between the interior of the heat transfer tube and the flexible shaft when the flexible shaft is inserted a given distance into the heat transfer tube;

a second substantially stationary seal on a portion of the delivery conduit that is to be positioned outside the plenum, the second seal being supported in a manner to form a substantially fluid tight seal between the flexible shaft and an interior of the delivery conduit while enabling the flexible shaft to slide there through; and a fluid inlet on the delivery conduit in fluid communication with the interior of the delivery conduit, between the flexible shaft and an interior wall of the delivery conduit, downstream of the second seal between the second seal and the first tube end.

2. The tool delivery system of claim 1 including a third seal supported at an end of the delivery conduit that is configured to interface with the first tube end, the third seal being structured to form a substantially fluid tight seal between the first tube end and the delivery conduit.

3. The tool delivery system of claim 1 wherein the flexible shaft is sufficiently rigid to push the tool forward until the first seal seats within the heat transfer tube to form the substantially tight seal between the flexible shaft and the interior of the heat transfer tube.

4. The tool deliver system of claim 1 including a fourth seal upstream of the second seal, the fourth seal structured to provide a substantially fluid tight seal between the flexible shaft and the delivery conduit while enabling the flexible shaft to slide there through with the space within the interior of the delivery conduit between the second seal and the fourth seal forming a chamber, including a port through a wall of the chamber.

5. The tool delivery system of claim 1 wherein the first and second seals are configured so that the tool and the flexible shaft can exit the delivery conduit.

6. The tool delivery system of claim 1 wherein the delivery tube is supported in sealed fluid communication with the first tube end with a robotic arm.

7. The tool delivery system of claim 1 wherein the first seal includes a plurality of circumferential outer segments that overlap a plurality of circumferential inner segments with the outer and inner segments being biased in an outwardly direction.

8. The tool delivery system of claim 7 including a fluid path having an inlet on an upstream side of the first seal in fluid communication with an inward surface of the inner segments.

9. The tool delivery system of claim 1 wherein the first seal includes circumferentially alternating seal pads and resilient elastomeric foam seal segments wherein the elastomeric foam seal segments conform to both the seal pads and an interior wall of the heat transfer tube to create a substantially fluid tight, slidable seal between the interior wall and the tool.

* * * * *